US005615921A

United States Patent [19]

Marley et al.

[11] Patent Number: 5,615,921

[45] Date of Patent: Apr. 1, 1997

[54] ERGONOMIC SHOPPING BAG HANDLE

[76] Inventors: Eugene Marley; Gerhard Hofmann, both of 1157 Highland Ave., Rochester, N.Y. 14620

[21] Appl. No.: 523,711

[22] Filed: Sep. 5, 1995

[51] Int. Cl.[6] ..... B65D 33/06

[52] U.S. Cl. ..... 294/170; 294/137

[58] Field of Search ..... 294/137, 143, 294/152–156, 158, 159, 165–171; 16/114 R, 114 B, 124–126; 229/117.09, 117.19, 117.21, 117.23–117.25; 383/6, 13, 15, 25, 26, 29; D8/300; D9/434, 455

[56] References Cited

U.S. PATENT DOCUMENTS

| | | | |
|---|---|---|---|
| 1,572,006 | 2/1926 | Griffin | 294/170 X |
| 4,841,596 | 6/1989 | Fink | 294/170 X |
| 4,991,894 | 2/1991 | Rutens | 294/137 X |

FOREIGN PATENT DOCUMENTS

| | | | |
|---|---|---|---|
| 756584 | 9/1933 | France | 294/170 |
| 224527 | 3/1943 | Switzerland | 294/170 |
| 9111368 | 8/1991 | WIPO | 294/170 |

*Primary Examiner*—Johnny D. Cherry
*Attorney, Agent, or Firm*—Cumpston & Shaw

[57] ABSTRACT

The present invention features a shopping bag handle that is ergonomically designed for easily carrying heavily-ladened shopping bags. The handle is substantially straight with a slight convex arc along its underside. The convex arc along the mid-section of the handle provides an ergonomic effect that conforms to the grip of a hand. An eye-loop is located on each distal end of the carrying handle. The loops of the shopping bag are easily threaded onto the eye-loops because of the downwardly-facing geometry of the latter. The central axis of the handle passes substantially through the contact points between the respective eye-loops of the handle and the loops of the shopping bag, thus reducing the moment of inertia between the middle portion of the handle and its distal ends. This reduced moment of inertia provides for a more stable carrying handle, substantially eliminating the tendency of a shopping bag to sway or rock about the handle.

6 Claims, 3 Drawing Sheets

ERGONOMIC SHOPPING BAG HANDLE

FIELD OF THE INVENTION

The present invention pertains to shopping bag appurtenances and, more particularly, to a reusable, ergonomic shopping bag handle that provides for an ease of handling and that does not deflect under heavy loads, thus maintaining its ergonomic shape.

BACKGROUND OF THE INVENTION

Handles are commonly provided for plastic shopping bags as a means to facilitate the carrying of groceries and other merchandise. One such carrying handle for supporting a shopping bag is illustrated in U.S. Pat. No. 4,991,894 (issued to RUTENS). RUTENS' carrying handle is a U-shaped, arcuate member that has upwardly disposed eye-loops on its distal ends for engagement with the loops of the shopping bag. The handle is easily attached to the shopping bag loops and is reusable.

The rounded, middle portion of the above-mentioned handle is uncomfortable, however, when one is carrying heavily-ladened shopping bags, or when it is gripped for long periods of time. The arcuate middle portion does not easily conform to a person's natural hand grip, and it tends to bite into the exterior fingers and palm of the hand of the user. In addition, the large, U-shaped, middle portion is not well designed for bags that are heavily ladened, as they tend to twist and rock about the distal loops.

The present applicants have analyzed the problems of the above-identified handle, and have determined that the large, U-shaped, arcuate middle portion offers a large moment of inertia with respect to the distal, contact loops. This large moment of inertia causes the aforementioned instability, when carried, of large or heavily-ladened shopping bags.

The present inventors seek to provide an improved shopping bag handle, one which is more comfortable to grip, and one which has a lower moment of inertia with respect to the contact loops disposed upon the distal ends.

The inventors have determined that the shopping bag handle should have a middle portion, with its central axis passing approximately through the contact point between the distal end loops and the shopping bag loops. This improved moment of inertia provides a more stabilized handle, which will easily accommodate heavily-ladened shopping bags without their swaying or rocking about the handle.

Applicants'carrying handle for shopping bags has been designed with a rounded middle portion for an ergonomically easy grip. The middle portion has an easily gripped, rounded cross-section and a substantially shallow, convex arc along its elongated, longitudinal axis. The convex arc of the middle portion provides a low moment of inertia with respect to the distal eye-loops. To prevent deflection under load, the cross-section is approximately one-half of an inch thick at the center of the middle portion. The elongated middle portion gradually tapers towards the eye-loops on the distal ends. The rounded cross-section of the eye-loops is approximately three-eighths of an inch. The smaller cross-section at the ends of the handle provide easy threading of the plastic loops of a shopping bag onto the handle's eye-loops. The smaller eye-loop cross-section also provides stability, as the center of gravity is concentrated at the larger, cross-sectioned middle portion of the handle.

It is an object of the present invention to provide an improved carrying handle for shopping bags.

It is another object of this invention to provide a shopping bag carrying handle that has a minimized moment of inertia, so as to prevent the swaying and rocking of the shopping bag about the handle.

It is a further object of this invention to provide a shopping bag carrying handle that has its center of gravity concentrated at a mid-section thereof, in order to improve the stability, when carried, of a heavily-ladened shopping bag.

It is yet another object of this invention to provide an improved, ergonomic, carrying handle for shopping bags.

SUMMARY OF THE INVENTION

In accordance with the present invention, there is provided a shopping bag handle that is ergonomically designed for the ease of carrying heavily-ladened shopping bags. The handle is substantially straight with a slight convex arc along its central axis. The convex arc along the mid-section of the handle provides an ergonomic effect that conforms to the grip of a hand. An eye-loop is disposed on each distal end of the carrying handle. The loops of a shopping bag are easily threaded onto the handle's eye-loops because of the eye-loops'downwardly facing geometry. The central axis of the handle passes substantially through the contact points between the handle's respective eye-loops and the loops of a shopping bag, thus reducing the moment of inertia between the middle portion of the handle and its distal ends. This reduced moment of inertia provides for a more stable carrying handle, substantially eliminating the tendency of a shopping bag to sway or rock about the handle's downwardly disposed eye-loops. The cross-section of the handle is uniformly circular, for ergonomically easy handling, and is tapered from the center to the distal ends, so as to provide the center of gravity concentrated about the middle portion. The concentration of the center of gravity about the mid-portion of the handle provides additional stability against the swaying and rocking of a shopping bag about the handle. The mid-portion of the handle is approximately one-half inch thick, tapering towards the distal end's eye-loops, which are approximately three-eighths-of-an-inch in diameter.

BRIEF DESCRIPTION OF THE DRAWINGS

A complete understanding of the present invention may be obtained by reference to the accompanying drawings, when considered in conjunction with the subsequent detailed description, in which.

For purposes of clarity and brevity, like elements and components will bear the same designations throughout the FIGURES.

DESCRIPTION OF THE PREFERRED EMBODIMENT

Figure 1:
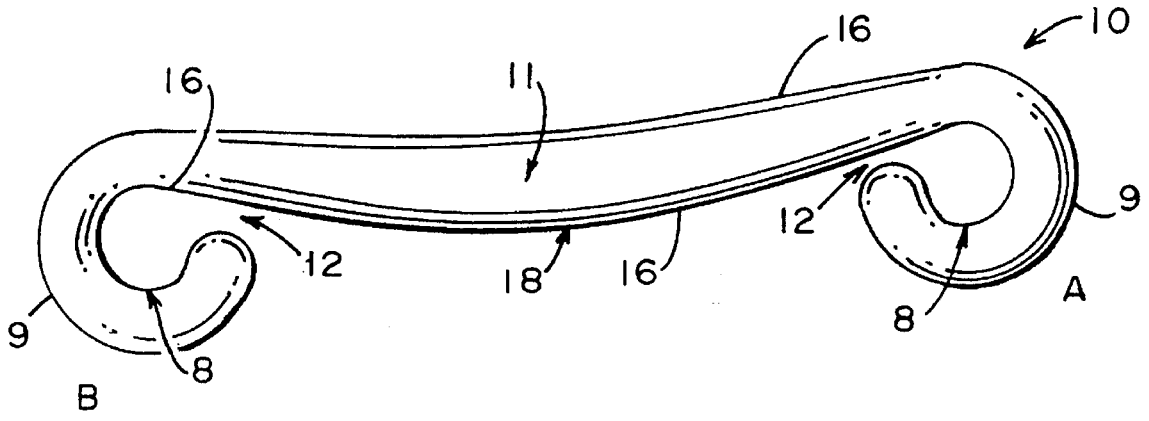
FIG. 1 illustrates a perspective view of the invention, a carrying handle for a shopping bag.

Generally speaking, the invention features a carrying handle for shopping bags. The handle comprises a substantially straight middle section with downwardly facing eye-loops at its respective distal ends. The loops of a shopping bag are designed to thread into the eye-loops of the carrying handle, which has a downwardly-facing geometry that allows for easy access. The handle has its longitudinal axis substantially in line with the contact point between the shopping bag loops and the eye-loops of the handle. This alignment provides a minimized moment of inertia and thus prevents swaying or rocking of a shopping bag with respect to the handle. The handle has a slight convex arc about its mid-portion, in order to conform to the grip of a hand. The rounded cross-section tapers towards the handle's distal ends, so that, for purposes of stability, the center of gravity concentrates towards the mid-section.

Now referring to FIGS. 1 and 3–6, the carrying handle 10 of this invention is shown in perspective, top, front, bottom and side views. The carrying handle 10 has a body portion 16, with a mid-section 11 having a circular cross-section. The mid-section 11 is approximately one-half inch in diameter, and tapers toward three-eighths inch in diameter at the eye-loops 9, disposed upon the handle's respective distal ends "A" and "B", as shown. The underbody 18 of the body portion 16 is slightly convex, in order to conform the handle to the natural, upward grip of the human hand (arrows 20), as shown in FIG. 2. As can be observed in FIG. 6, the body 16 of the handle 10 is generally circular. The central axis 19 of the handle 10 is shown passing through the eye-loops 9. The proximity of the axis 19 to the point of contact of the loops 15 (FIG. 2) of a shopping bag 14 and the eye-loops 9 of the handle 10 provides a small moment of inertia about the handle 10. This prevents the swaying of bag 14 within the eye-loops 9 of the handle 10. The tapering from the mid-section 18 to the distal ends A and B also concentrates the center of gravity in the mid-section 18, so that the handle 10 is more stable than the ordinary handles of uniform diameter.

Figure 2:
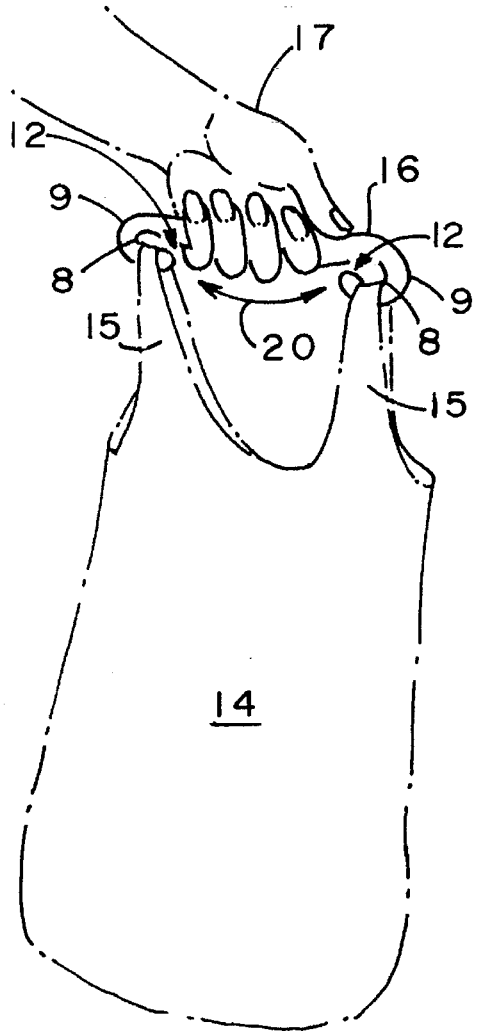
FIG. 2 depicts an in situ view of the inventive carrying handle shown in FIG. 1.
Figure 3:
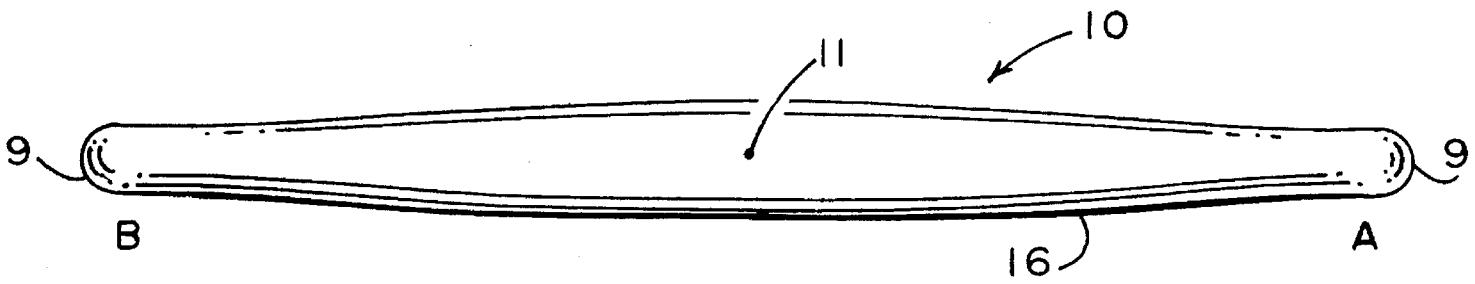
FIG. 3 shows a top view of the inventive carrying handle depicted in FIG. 1.
Figure 4:
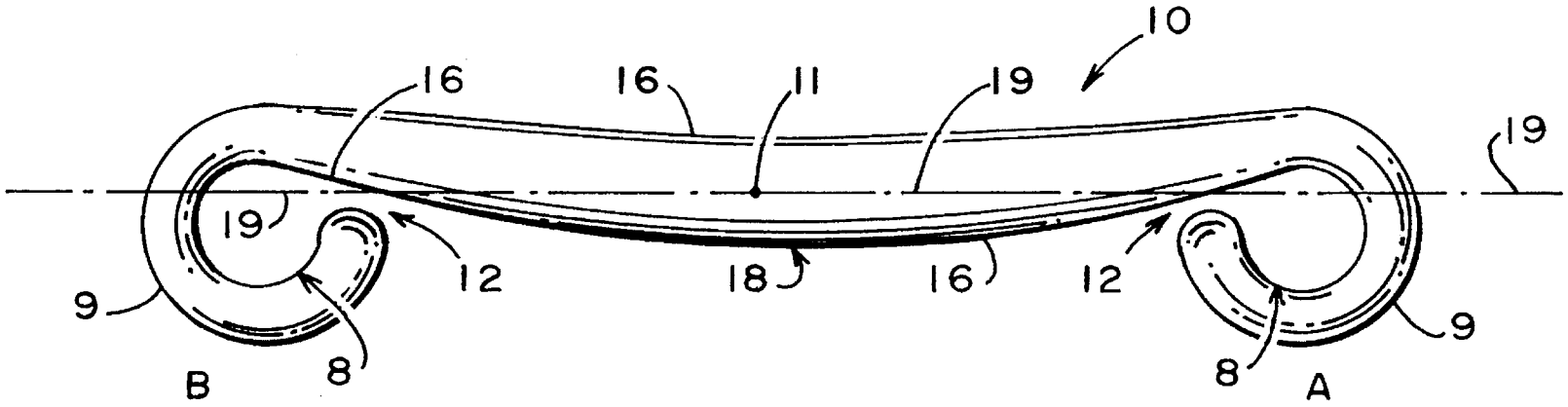
FIG. 4 illustrates a front view of the inventive carrying handle shown in FIG. 1.
Figure 5:
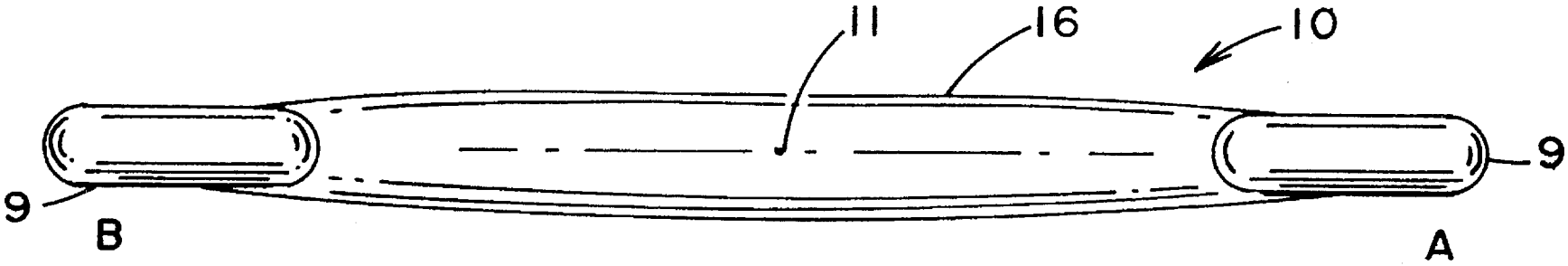
FIG. 5 depicts a bottom view of the inventive carrying handle illustrated in FIG. 1.
Figure 6:
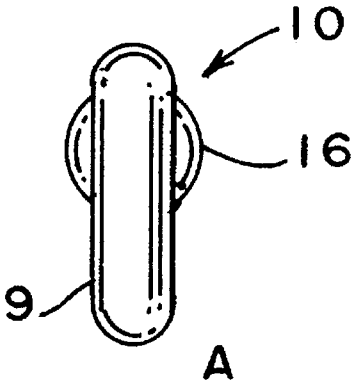
FIG. 6 shows a side view of the inventive carrying handle depicted in FIG. 1.

Referring again to FIG. 2, a plastic shopping bag 14 is shown in a supported position upon the handle 10 depicted in FIG. 1. The respective loops or handles 15 of the shopping bag 14 have been threaded through the narrow openings 12 between the eye-loops 9 and the body 16 of the handle 10. The loops or handles 15 of the shopping bag 14 are captured and supported upon the inner surface 8 of the eye-loops 9. The narrow (i.e., twenty-thousandths of an inch, or, 0.02") openings 12 between the eye-loops 9 and the body 16 of the handle 10 provide the necessary and sufficient space to accommodate the shopping bag loops or handles 15, while also minimizing the risk of the accidental separation of the shopping bag loops or handles 15 from the eye-loops 9. The carrying handle 10 is shown being gripped by a hand 17. The upward grip (arrows 20) of the hand 17 is shown to conform to the arcuate, slightly convex shape 18 (FIGS. 1 and 4) of the handle 10. This conformity provides an ergonomic benefit, wherein the hand is less tired when using this invention and gripping a heavily-ladened bag 14 over an extended period of time. The rounded or circular shape of the body portion 16 also conforms to the natural grip of the hand 17. The natural tapering of the body portion 16 of the handle 10, from the mid-section 18 to the distal ends A and B, also conforms to the size of the fingers in the hand 17, from the index to the smallest finger.

The handle 10 can generally be molded from various plastics, such as polypropylene.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A carrier for shopping bags having handles, comprising: a generally cylindrical body having a substantially circular cross-section throughout its length, said body having an underside that is a substantially convex arc, said body being formed into an eye-loop at each end of said body, each of said eye-loops having an end positioned proximate said body to form a gap wide enough to easily accommodate a shopping bag handle while also minimizing the risk of accidental separation of a shopping bag handle from said eye-loops, said body further having a central axis that passes substantially through said eye-loops.

2. A Carrier for shopping bags having handles, comprising: a generally cylindrical body having a decreasing taper from a mid-portion to distal ends, said body having an underside that is a substantially convex arc, said body being formed into an eye-loop at each end of said body, each of said eye-loops having an end positioned proximate said body to form a gap wide enough to easily accommodate a shopping bag handle while also minimizing the risk of accidental separation of a shopping bag handle from said eye-loops, said body further having a central axis that passes substantially through said eye-loops.

3. A Carrier for shopping bags having handles, comprising: a generally cylindrical body having a substantially circular cross-section throughout its length, said body having a decreasing taper from a mid-portion to distal ends, said body having an underside that is a substantially convex arc, said body being formed into an eye-loop at each end of said body, each of said eye-loops having an end positioned proximate said body to form a gap wide enough to easily accommodate a shopping bag handle while also minimizing the risk of accidental separation of a shopping bag handle from said eye-loops, said body further having a central axis that passes substantially through said eye-loops.

4. The handle according to claim 1, wherein the gap between the eye-loop end and the handle body is about 0.020 inches.

5. The handle according to claim 2, wherein the gap between the eye-loop end and the handle body is about 0.020 inches.

6. The handle according to claim 3, wherein the gap between the eye-loop end and the handle body is about 0.020 inches.

* * * * *